United States Patent [19]

Johnston

[11] 4,162,574

[45] Jul. 31, 1979

[54] HAIR CLIPPER

[76] Inventor: Mack S. Johnston, 1065 Lomita Blvd. #220, Harbor City, Calif. 90710

[21] Appl. No.: 881,808

[22] Filed: Feb. 27, 1978

[51] Int. Cl.[2] ..... B26B 19/14

[52] U.S. Cl. ..... 30/29.5

[58] Field of Search ..... 30/29.5

[56] References Cited

U.S. PATENT DOCUMENTS

| | | | |
|---|---|---|---|
| 2,235,326 | 3/1941 | Muros | 30/29.5 |
| 2,262,315 | 11/1941 | Davies | 30/29.5 |
| 2,946,121 | 7/1960 | Marach | 30/29.5 |
| 3,699,652 | 10/1972 | Deverman | 30/29.5 |
| 3,731,379 | 5/1973 | Williams | 30/29.5 |

*Primary Examiner*—Jimmy C. Peters

*Attorney, Agent, or Firm*—LeBlanc & Shur

[57] ABSTRACT

A cutter for cutting facial hair in the vicinity of the nose and ears employing a body portion having a cutting end with teeth upstanding therefrom and cutting means cooperating with the teeth to cut the hair which extends in between the teeth. The cutting means includes a coil rotatably carried within the housing which is rotated by the user when the cutter is placed in the vicinity of the nostril and ears to effect the cuttings of the hair lying in between the teeth.

15 Claims, 5 Drawing Figures

FIG.1
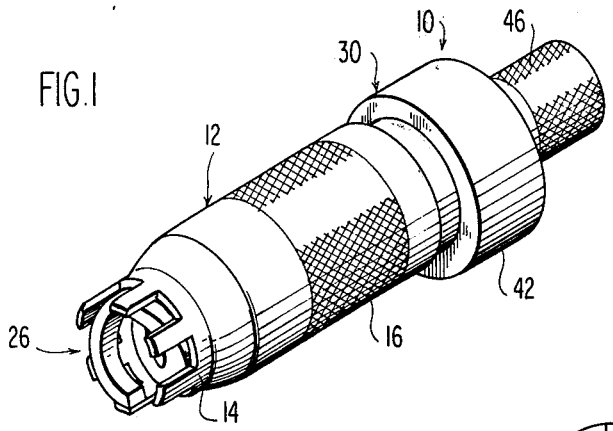
FIG.2
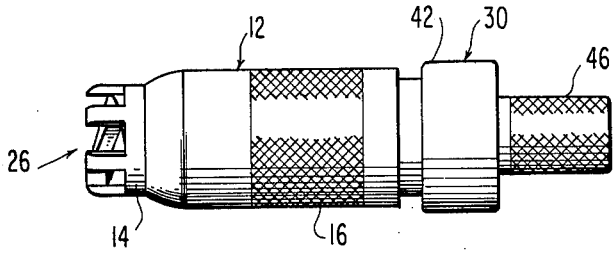
FIG.3
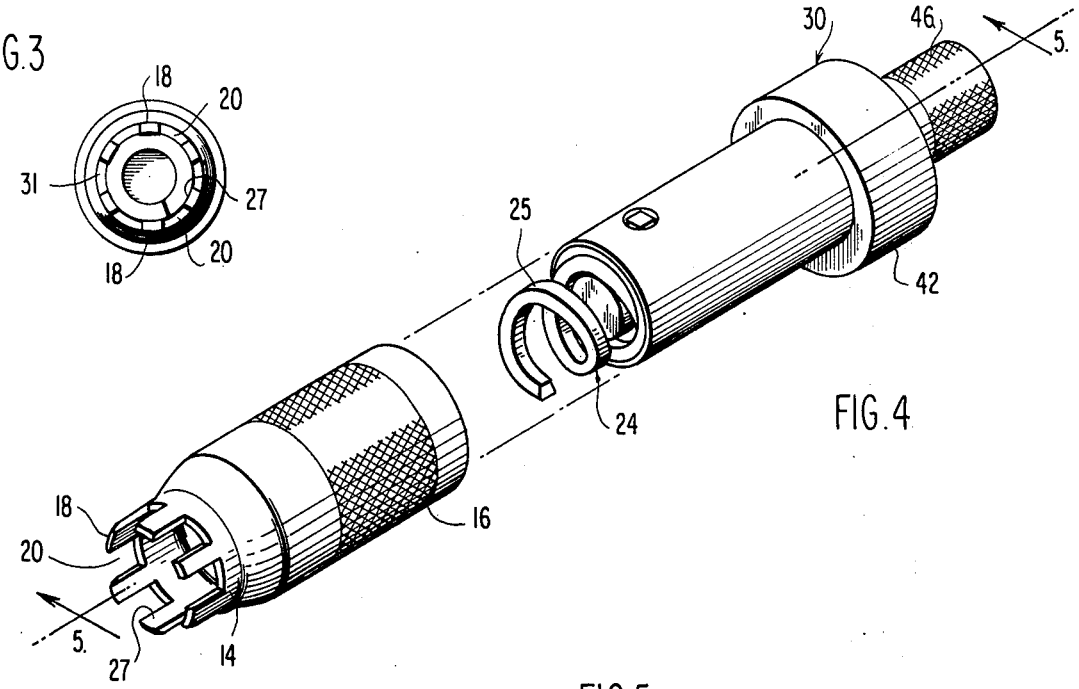
FIG.4
FIG.5
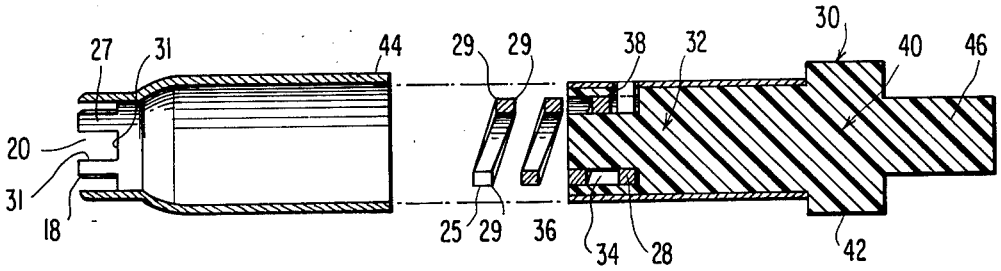

HAIR CLIPPER

BACKGROUND OF THE INVENTION

The special cutters have typically been employed for cutting the facial hair located in the vicinity of the nose and ears, since other methods for cutting hair in these areas simply has not proved effective. For example, the use of scissors requires that they be operated in rather awkward positions to get at the hair in the remote areas such as that within the nostrils and ears. The problem with the use of scissors is that a slight movement or jarring in the wrong direction may result in a puncture of the skin in these areas causing slight pain and discomfort. Devices used in shaving and in cutting facial hair such as razor blades and electric razors typically are not configured properly for easy access to hair within these relatively confined areas. As a result, specially configured cutters have been required for this purpose.

An example of such a cutter is U.S. Pat. No. 2,312,933 to Seider which discloses a rotary clipper for nose and ear cavities adapted to be hand operated. The Seider device includes a head having a circle of comblike teeth or prongs extending therefrom. A portion of the head includes an annular slot for receiving a rotary shear knife thimble or cutter blade which rotates within the slot to cut the hairs in the vicinity of the prongs. In addition to rotation, there is also a provision in the Seider device for movement of the cutter blades in a longitudinal direction through the interaction of cam device. The cutter blades are operated in this rotational and longitudinal motion by a turn knob at the end of the device opposite to the head.

Another example of such a special cutter is shown in the U.S. Pat. No. 2,461,858 to Towers which employs spiral cutters for shaving. However, a clipper is provided for cutting the hair around the ears and nostrils. The clippers shown utilize projecting fingers on outer rings of the spiral cutters which interact with teeth on combplate sections to effect the cutting of the hair in the more remote areas.

The problem with the special cutters which have characterized the prior art, of which the above two patents are examples, is that they are rather complex in configuration and typically do not maintain their cutting effectiveness over long periods of time. In addition, they are susceptible because of their complex configurations to bending and breaking primarily due to the dimensions of the teeth used in connection with the cutting process. Furthermore, it is difficult to maintain dimensional integrity to ensure effective cutting surfaces due to the complex configuration employed.

It is an object of the invention described herein to overcome many of the deficiencies which have characterized these types of special cutters in the past.

More specifically, it is an object to provide a cutter having teeth with slots therebetween utilizing a rotable member which is more efficient, more dependable, and cheaper to manufacture than cutters which have characterized the prior art.

SUMMARY OF THE INVENTION

Generally, the invention relates to a cutter for cutting facial hair in the vicinity of the nostrils and ears employing a coil rotatably within a housing in conjunction with slot means to cut the hair which extends into the slot. More specifically, as defined in the preferred embodiment hereinafter, the cutter includes a generally cylindrical housing having several slots defined between teeth located at one end of the housing. A coil member is rotatably carried within the housing and cooperates with the upstanding teeth to cut the hairs which extend into the slots. A knob member extends from the other end of the housing and is connected to the coil for rotating it to effect the cutting.

BRIEF DESCRIPTION OF THE DRAWINGS

FIG. 1 is a perspective view of the cutter.

FIG. 2 is an elevation of the cutter.

FIG. 3 is an end view of the cutter.

FIG. 4 is an exploded perspective view of the cutter, and

FIG. 5 is a section view of FIG. 4 taken along lines 5—5.

DETAILED DESCRIPTION OF THE PREFERRED EMBODIMENT

The cutter generally referred to by the reference numeral 10 includes a housing 12 which is a hollow cylindrical body having an upper portion 14 and a lower portion 16. As can be seen from FIGS. 1 and 4, the upper portion 14 has a slightly smaller diameter than the lower portion 16. A cutter end 26 is formed by slots 20 defined around the periphery of this upper portion 14 between teeth 18 equally spaced around the perimeter of the upper portion 14. Each slot is defined by a bottom cutting edge 31 between the teeth 18. The slots are open ended which allow the hairs to fall readily within the slots during operation of the cutter.

A coil member 24 is carried within the housing 12 in relative rotational movement such that rotation of the coil will effect cutting of the hair located within the slots 20. More specifically, the coil member defines a peripheral surface at the cutter end 26 of the coil member 24 for engaging the inner surface 27 of the teeth 18. Because of the helical configuration, in any given slot 20 rotation of the coil 24 effects movement of the edge 29 toward edge 31 at the bottom of the slot 20. Continued rotation will eventually bring the edge 29 into cutting engagement with edge 31 to effect cutting in a manner similar to the action of scissors. Typically in operation, the cutting end 26 is located so that hair will extend into the slots 20. The coil 24 is then rotated allowing the edge 29 to engage the hair and move it toward the edge 31 of the slot 20. Continued rotation will eventually cause the hair to be cut in the manner described above.

The coil member 24 includes a connecting end 28 which is secured to a knob member 30. This knob member 30 includes an internal portion 32 having an end 36 in which there is defined an annular recess 34 concentric with the housing 12. The connecting end 28 of the coil member 24 is secured within this annular recess 34 by any suitable means. A stop 38 is provided within the annular recess 34 to prevent rotation of the coil member 24 relative to the knob member 30.

An external portion 40 of the knob member 30 includes a flange 42 which extends beyond the bottom 44 of the housing 12. A rod 46 extends from this flange for grasping by the operator to rotate the coil effecting the cutting operation. With this configuration during the operation of the cutter, the coil cannot be extended beyond the cutter end of the housing because of the inner action of the flange with the bottom 42. As a result, the knob member 30 and coil member 24 can only be moved in a longitudinal direction relative to the housing away from the cutter end. This prevents inadvertent movement of the relatively sharp coil from the cutter end in a manner which may injure the person using the cutter.

In addition, by having the upper portion of slightly smaller diameter than the lower portion of the housing, the cutter is prevented from extending too far into the cavity where the hair is being cut. This is particularly important in using the cutter with facial hair in the ear cavity where extension of the cutter beyond that which is necessary could damage the ear drum. By having the larger diameter lower portion typically the cutter will be prevented from access to a depth within the ear where such damage could occur.

In this preferred embodiment, the coil member employed includes a 0.032 to 0.062 inch square wire having about a 0.314 diameter with eight coils per inch. The length of the coil is 0.562 inches. By using this type of coil it is found that the desired cutting between the peripheral surface on the coil and the inner surface of the teeth is accomplished effectively. By using a coil in this manner, the cutter is much more structurally efficient avoiding the possibility of bending or breaking which characterize other cutters used for this purpose. As a result, the cutting tolerances can be maintained for substantially longer periods thereby extending the life of the cutter. In addition, the configuration is relatively simple to manufacture which makes the device one which is economical as well as efficient.

The invention may be embodied in other specific forms without departing from the spirit or central characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

I claim:

1. A cutter for cutting facial hair in the vicinity of the nostrils and ears comprising:

a body portion having a cutter end with teeth upstanding therefrom;

slot means being defined between said teeth wherein at least one of said slot means includes a slot having an open end for receiving hair therein;

a coil means rotatably carried within said body portion, said coil means having at least a portion thereof being located adjacent said slot means whereby rotation of said coil means results in cutting of said hair extending into said slot means.

2. The cutter according to claim 1 wherein said slot means includes a plurality of slots with substantially all of said slots having an open end for receiving hair therein.

3. The cutter according to claim 2 wherein said cutting end defines a bottom cutting edge between said teeth and said coil means having a peripheral surface, at least a portion of said peripheral surface being in substantial engagement with said bottom cutting edge for effecting cutting of said hair located in said slot means upon rotation of said coil means.

4. The cutter according to claim 3 further comprising a knob member exposed from said body portion for gripping by a user of said cutter said knob member being connected to said coil for rotating said coil.

5. The cutter according to claim 4 wherein said body portion is substantially cylindrical in configuration and surrrounding said coil means for relative rotational movement.

6. The cutter according to claim 5 wherein said cutter end extends from one end of said body portion and said knob member extends in an opposite direction of said cutter end.

7. The cutter according to claim 6 wherein said body portion has an upper portion and a lower portion said upper portion having a smaller diameter than said lower portion with said teeth with said slot means defined therebetween being defined within said upper portion at the cutter end.

8. The cutter according to claim 7 wherein said knob member has an internal part and an external part, said internal part having an effective diameter less than that of said lower portion of said body portion allowing rotation of said internal part relative to said external part including a flange having an effective diameter greater than that of said lower portion to prevent said coil from extending beyond the end of said cutter end, said flange having a gripping member extending therefrom from grasping by the user to rotate said knob member for rotating said coil to cut hair located in the slot means.

9. The cutter according to claim 8 wherein said coil includes a square wire with one end secured to the internal part of said knob member and the other end in cutting engagement with said bottom cutting edge.

10. The cutter according to claim 9 wherein said slots are defined parallel to the longitudinal axis of said body portion around the cutter end of said cutter.

11. The cutter according to claim 10 wherein said cutter end defines eight teeth with seven slots therebetween.

12. The cutter according to claim 11 wherein said coil means includes a square wire coil having eight coils per inch with an effective diameter substantially 0.562 inches where the square wire has a width of substantially 0.062 inches and an outer diameter of 0.314 inches.

13. The cutter according to claim 12 wherein said gripping member is made of plastic.

14. The cutter according to claim 13 wherein said gripping member includes a stop for preventing rotation of said coil relative to said gripping member.

15. A cutter for cutting facial hair in the vicinity of the nostrils and ears comprising a housing being generally cylindrical in configuration defining a cutter end and a knob end, said cutter end having a plurality of teeth extending longitudinally therefrom parallel to the longitudinal axis of said housing equidistant from one another defining slots therebetween, each of said slots being open at one end for receiving hair therein;

a square wire coil rotatably carried within said housing said oil defining a peripheral surface, said cutter end defining a bottom cutting edge between said slots, said coil having an effective diameter such that said peripheral surface is in substantial cutting engagement with said bottom cutting edge for cutting hair located in said slots upon rotation of said coil;

said housing further including a knob member, said knob member having an internal portion and an external portion, said external portion extending from said knob end, said internal portion having an effective diameter less than that of said housing for being rotatable relative thereto, said coil being connected to said internal portion of said knob member such that rotation of said external portion will produce a corresponding rotation of said coil relative to said teeth for cutting hair located in said slot means.

* * * * *

UNITED STATES PATENT OFFICE

CERTIFICATE OF CORRECTION

Patent No. 4,162,574 Dated July 31, 1979

Inventor(s) Mack S. Johnston

It is certified that error appears in the above-identified patent and that said Letters Patent are hereby corrected as shown below:

Column 3, line 38, change "therein" to --herein--.

Claim 15,column 4, line 51 change "oil" to --coil--.

Signed and Sealed this

*Eighth* Day of *January 1980*

[SEAL]

*Attest:*

SIDNEY A. DIAMOND

*Attesting Officer* *Commissioner of Patents and Trademarks*